US007997856B2

(12) United States Patent
Khanin et al.

(10) Patent No.: US 7,997,856 B2
(45) Date of Patent: Aug. 16, 2011

(54) STATOR HEAT SHIELD

(75) Inventors: Alexander Khanin, Moscow (RU); Edouard Sloutski, Moscow (RU); Sergey Vorontsov, Moscow (RU); Anton Sumin, Moscow (RU)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 12/579,464

(22) Filed: Oct. 15, 2009

(65) Prior Publication Data

US 2010/0047062 A1 Feb. 25, 2010

Related U.S. Application Data

(63) Continuation of application No. PCT/EP2008/054140, filed on Apr. 7, 2008.

(30) Foreign Application Priority Data

Apr. 19, 2007 (CH) ..... 645/07

(51) Int. Cl.
*F01D 5/08* (2006.01)

(52) U.S. Cl. ..... 415/116; 415/139; 415/173.1; 415/177; 415/178

(58) Field of Classification Search ..... 415/116, 415/139, 173.1, 177, 178
See application file for complete search history.

(56) References Cited

U.S. PATENT DOCUMENTS 3,728,039 A * 4/1973 Plemmons et al. ..... 415/115
4,497,610 A * 2/1985 Richardson et al. ..... 415/116
4,573,865 A * 3/1986 Hsia et al. ..... 415/115
6,302,642 B1 * 10/2001 Nagler et al. ..... 415/116
6,340,285 B1 * 1/2002 Gonyou et al. ..... 415/116
6,508,623 B1 * 1/2003 Shiozaki et al. ..... 415/173.1

(Continued)

FOREIGN PATENT DOCUMENTS

EP 1048822 11/2000

(Continued)

OTHER PUBLICATIONS

Search Report for Swiss Patent App. No. 0645/2007 (Sep. 5, 2007).

(Continued)

*Primary Examiner* — Igor Kershteyn
(74) *Attorney, Agent, or Firm* — Cermak Nakajima LLP; Adam J. Cermak

(57) ABSTRACT

A stator heat shield (6) for a gas turbine (1) includes an outside (11) which in the installed state faces a hot gas path (9) of the gas turbine (1), and an inside (12) facing away from the outside (11). A plurality of ribs (13) are formed on the inside (12) and extend axially in the installed state with regard to an axis of rotation (8) of a rotor (3) of the gas turbine (1) and, in the circumferential direction, are spaced a distance apart from one another. At least one baffle plate (14) is arranged on the inside (12) and is in contact with the ribs (13). At least one groove (16) is designed in an end face (15) bordering the stator heat shield (6) in the circumferential direction, into which at least one sealing element (18) can be inserted. A plurality of bores (19) are included, each opening at a distance from the groove (16) in the direction of the outside (11) at the inside (12) at one end and on the end face (15) at the other end and arranged a distance apart from one another in the axial direction.

13 Claims, 2 Drawing Sheets

U.S. PATENT DOCUMENTS

| | | | | |
|---|---|---|---|---|
| 6,602,048 | B2 * | 8/2003 | Fujikawa et al. | 415/116 |
| 7,033,138 | B2 * | 4/2006 | Tomita et al. | 415/139 |
| 7,246,993 | B2 * | 7/2007 | Bolms et al. | 415/116 |
| 7,387,488 | B2 * | 6/2008 | Nichols et al. | 415/116 |
| 2001/0005555 | A1 | 6/2001 | Kreis et al. | |
| 2004/0047725 | A1 | 3/2004 | Tomita et al. | |

FOREIGN PATENT DOCUMENTS

| | | |
|---|---|---|
| EP | 1176285 | 1/2002 |
| EP | 1517008 | 3/2005 |
| EP | 1749975 | 2/2007 |
| EP | 1775423 | 4/2007 |
| WO | WO03/006883 | 1/2003 |
| WO | WO2008/128876 | 10/2008 |

OTHER PUBLICATIONS

International Preliminary Report on Patentability for PCT Patent App. No. PCT/EP2008/054140 (Jul. 7, 2009).

* cited by examiner

STATOR HEAT SHIELD

This application is a Continuation of, and claims priority under 35 U.S.C. §120 to, International application no. PCT/EP2008/054140, filed 07 Apr. 2008, and claims priority therethrough under 35 U.S.C. §§119, 365 to Swiss application no. 00645/07, filed 19 Apr. 2007, the entireties of which are incorporated by reference herein.

BACKGROUND

1. Field of Endeavor

The invention relates to a stator heat shield for a gas turbine and a gas turbine equipped with such a stator heat shield.

2. Brief Description of the Related Art

In the installed state, stator heat shields are situated on a stator and/or on a housing of a gas turbine. They are usually mounted on a guide vane carrier and form a radial border for a hot gas path of the gas turbine in the area of the rotor blades of a rotor of the gas turbine. As a rule, a plurality of such stator heat shields is arranged adjacent to one another in the circumferential direction with regard to an axis of rotation of the rotor, thereby forming a closed ring of individual stator heat shields. The individual stator heat shields here form ring segments. The stator heat shields protect the housing and/or the guide vane carriers from exposure to the hot gas of the gas turbine. The outside of the stator heat shields is exposed to the hot gas, while the inside of the respective stator heat shield facing away from the hot gas path is exposed to a suitable cooling gas to cool the respective stator heat shield. Due to this cooling, the lifetime of the stator heat shields can be increased. Fundamentally, however, there is a need for increasing the lifetime of such stator heat shields further.

SUMMARY

This is where aspects of the present invention begin. One of numerous aspects of the present invention relates to the problem of providing an improved embodiment for a stator heat shield and/or a gas turbine equipped therewith such that it is characterized in particular by a longer lifetime of the stator heat shields.

Another aspect of the present invention relates to the general idea of combining baffle plate cooling, convection cooling, and sealing element cooling in the respective stator heat shield. It has been found that a combination of these cooling methods or cooling techniques results in effective cooling and a favorable temperature distribution in the respective stator heat shield, which increase the lifetime of the stator heat shields accordingly.

In the installed state of the stator heat shield, a plurality of channels may be formed on the inside due to a plurality of ribs formed on the inside facing away from a hot gas path of the gas turbine, which extend axially in the installed state relative to an axis of rotation of a rotor of the gas turbine, and are spaced a distance apart from one another in the circumferential direction. At the same time, these ribs serve to reinforce the respective stator heat shield. In addition, a baffle plate is provided on the inside with the baffle plate supported on the ribs. In this way, heat can be transmitted by convection from the stator heat shield to the respective baffle plate within the channels. The baffle plate itself is exposed to a cooling gas during operation of the gas turbine, so that the heat can be dissipated from the baffle plate. In addition, the respective stator heat shield is equipped with a groove at least on an end face adjacent to the stator heat shield in the circumferential direction, so that at least one sealing element can be inserted into this groove. Two stator heat shields adjacent to one another in the circumferential direction border one another in the area of these end faces, whereby as a rule a relatively small gap is formed. The respective sealing element then engages in the aligned and flush grooves of the two end faces opposite one another in the gap, thereby sealing the gap and thus sealing the connection between the hot gas path facing the outside with a cooling gas path facing the inside. To cool this sealing element, the stator heat shield includes multiple bores, each opening on the inside at one end and on the end face at the other end, in such a way that they open at a distance from the groove in the direction of the outside. Furthermore, the bores are arranged with a distance between them in the axial direction. Cooling gas from the cooling gas path can reach the hot gas side through these bores in the gap between stator heat shields adjacent to one another in the circumferential direction and can supply cooling gas to the sealing elements there. In particular, film cooling of the sealing elements and the end faces of the neighboring stator heat shields opposite one another in the gap can be achieved in the area of the gap. Targeted cooling of this area reduces the temperatures are the respective stator heat shield at the ends, which reduces the heat burden on the stator heat shield and increases its lifetime.

An exemplary embodiment, in which a recess is formed on the respective end face at a distance from the groove in the direction of the outside, is especially advantageous, the recess being open toward the outside and extending in the axial direction over the bores of the respective end face and in which the bores open. Providing such a recess achieves the effect that cooling gas can enter the hot gas side of the gap even when the stator heat shields adjacent to one another in the circumferential direction are offset with respect to one another with their end faces opposite one another in the gas, thereby minimizing the gap. Such a gap reduction may occur in certain operating situations of the gas turbine.

Other important features and advantages are derived from the drawings and the respective description of the figures on the basis of the drawings.

BRIEF DESCRIPTION OF THE DRAWINGS

A preferred exemplary embodiment of this invention is depicted in the drawings and explained in greater detail in the following description, where the same reference numerals refer to the same or similar or functionally identical components.

In the figures, each shown schematically.

DETAILED DESCRIPTION OF EXEMPLARY EMBODIMENTS

Figure 1:
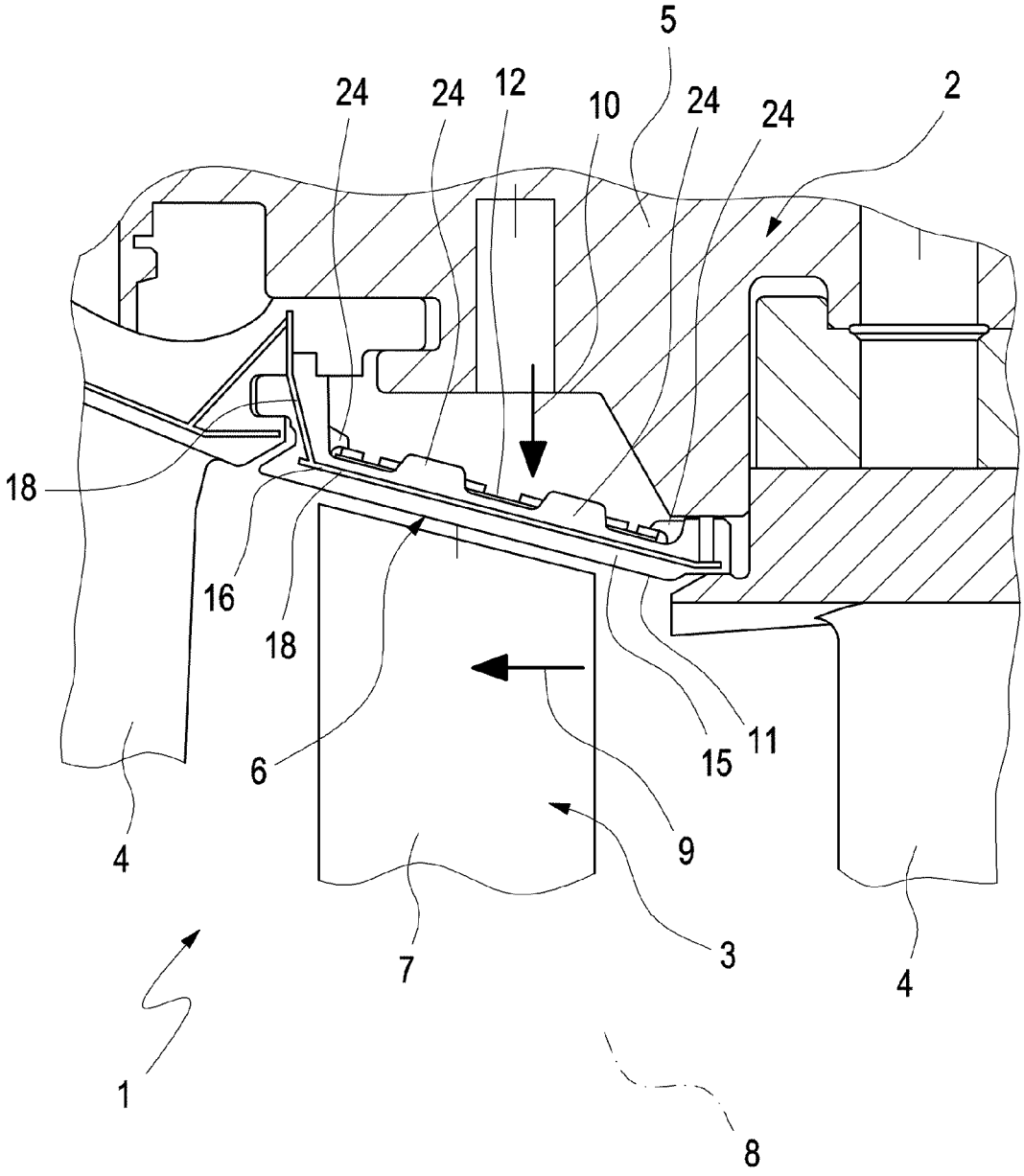
FIG. 1 shows an axial section through a gas turbine in the area of a stator heat shield.

According to FIG. 1, a gas turbine 1, only a small detail of which is shown here, has a stator 2 and a rotor 3, each of which is also shown only in part. Of the stator 2, guide vanes 4 are partially discernible as well as a section of a guide vane carrier 5. First, the guide vanes 4 are attached to the guide vane carrier 5; secondly, stator heat shields 6 are also mounted on the guide vane carrier 5, only one of which is discernible here. Of the rotor 3, only one turbine blade 7 is discernible here, this blade being arranged between the two guide vanes 4. An axis of rotation 8 about which the rotor 3 rotates during operation of the gas turbine 1 and which defines the axial direction of the gas turbine 1 is indicated here with a dash-dot line. Axial in the present context thus means parallel to the axis 8 of rotation, whereas a radial direction is perpendicular to the axis 8 of rotation and the circumferential direction is oriented along a circular path about the axis 8 of rotation. Accordingly, the rotor blade 7 is arranged axially between the two guide vanes 4. The stator heat shield 6 is arranged radially opposite the rotor blade 7 and is positioned axially between the two guide vanes 4.

The individual stator heat shields 6 form segments which are arranged adjacent to one another in the circumferential direction and form a closed circular ring surrounding a rotor blade row formed by rotor blades 7 adjacent to one another in the circumferential direction. The respective stator heat shield 6 separates a hot gas path 9 of the gas turbine 1, which is indicated by an arrow, from a cooling gas path 10, which is also indicated by an arrow and runs essentially in the stator 2.

Figure 2:
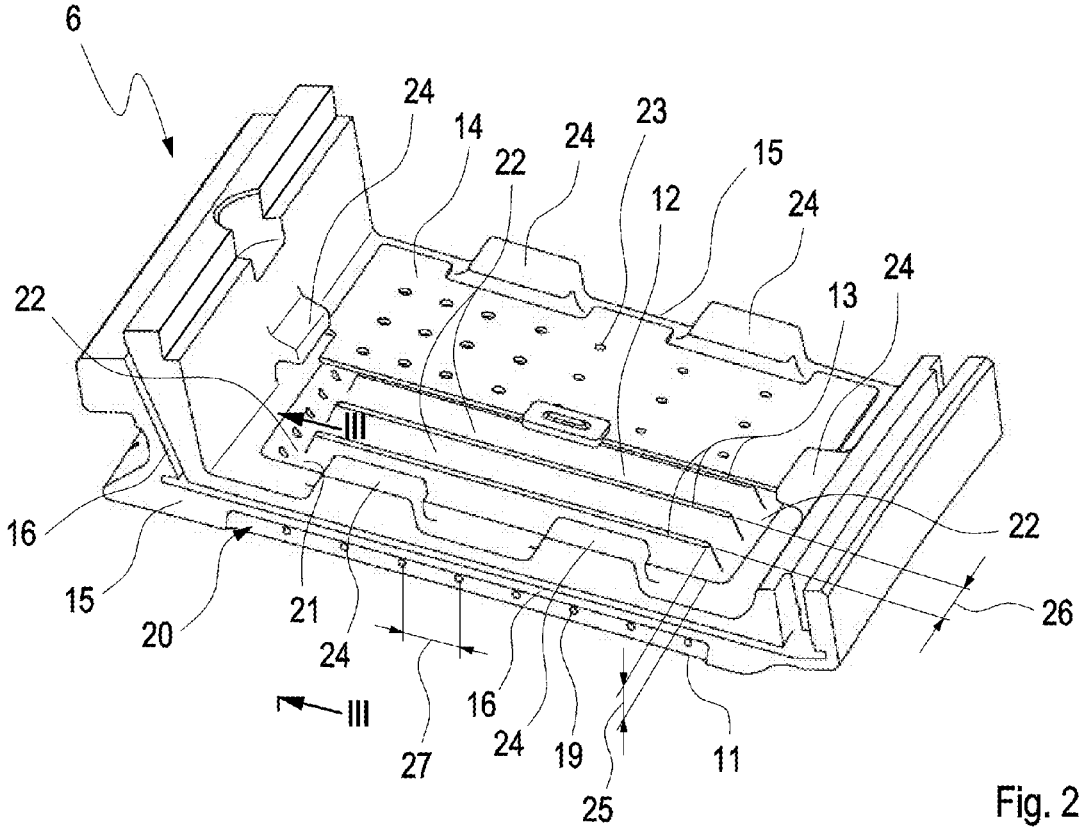
FIG. 2 shows a perspective view of a stator heat shield.

According to FIGS. 1 and 2, the respective stator heat shield 6 has an outside 11 which faces the hot gas path 9 in the installed state. Likewise, the stator heat shield 6 has an inside 12 which faces the cooling gas path 10 and/or faces away from the hot gas path 9 and the outside 11. On its inside 12, the stator heat shield 6 has multiple ribs 13. These ribs 13 extend axially in the installed state and are preferably designed in a straight line. In addition, the ribs 13 are arranged a distance apart in the circumferential direction. Furthermore, at least one baffle plate 14 is arranged on the inside 12 and is in contact with the ribs 13. In the examples shown in FIG. 2, the baffle plate 14 extends over only half of the inside 12. A second baffle plate 14 which covers the other half is omitted here to make it easier to see the ribs 13. Likewise, a single baffle plate 14 covering all the ribs 13 may be provided.

Figure 3:
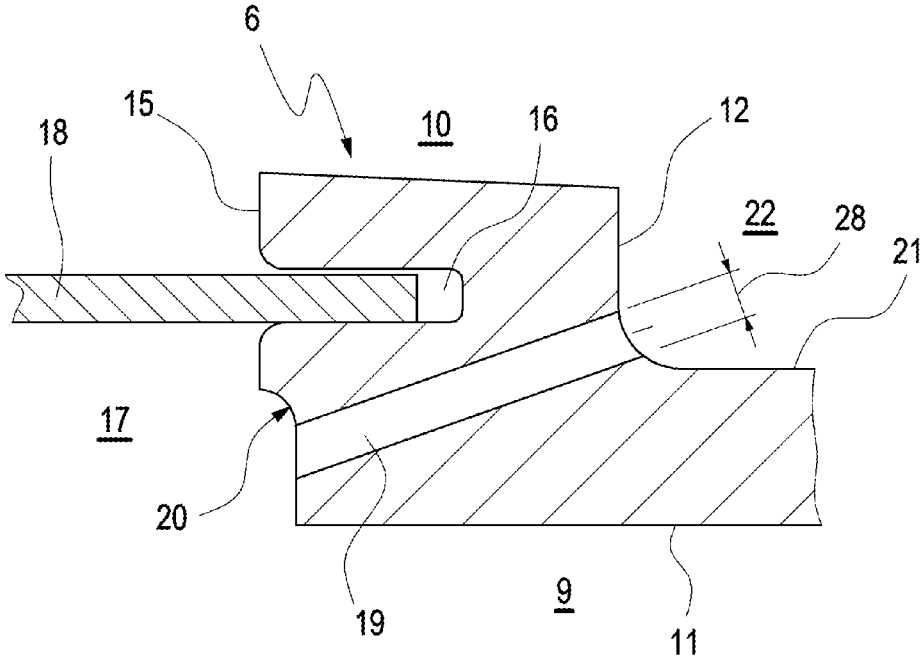
FIG. 3 shows a cross section through the stator heat shield in the area of one end face according to the sectional lines III in FIG. 2.

The respective stator heat shield 6 also has two end faces 15 in the circumferential direction, each end face bordering a stator heat shield 6 in the circumferential direction. A groove 16 has been cut in at least one of these end faces 15. One such groove 16 is preferably cut in both end faces 15. In the installed state, two stator heat shields 6 adjacent to one another in the circumferential direction border one another in the area of these end faces 15, with two such end faces 15 being opposite one another in an axial gap 17 as indicated in FIG. 3. The grooves 16 are arranged so that they are oriented flush with one another with opposing end faces 15 in the axial gap 17. The respective groove 16 serves to receive at least one sealing element 18 which is designed in the form of a strip or band, for example. In the area of the axial gap 17, such a sealing element 18 engages in the two flush grooves 16 simultaneously on two end faces 15 opposite one another in the gap 17. In this way the respective sealing element 18 can seal the axial gap 17, i.e., can separate the hot gas side facing the hot gas path 9 from the cooling gas side facing the cooling gas path 10.

According to FIGS. 2 and 3, the stator heat shield 6 is also equipped with multiple bores 19. Each of these bores 19 connects the inside 12 of one of the end faces 15. Accordingly, the respective bore 19 opens on the inside 12 at one end and on the respective end face 15 at the other end. The mouth of the respective bore 19 on the respective end face 15 is arranged at a distance from the groove 16, namely in the direction toward the outside 11. In this way, cooling gas can go through the bores 19 from the cooling gas side and/or from the cooling gas path to the hot gas side of the gap 17, which is open toward the hot gas path 9. The individual bores 19 are arranged a distance apart from one another in the axial direction on the respective end face 15 of the stator heat shield 6 according to FIG. 2.

According to FIGS. 2 and 3, the stator heat shield 6 has a recess 20 on at least one of the end faces 15, the recess being open only toward the outside 11 and extending axially along the respective side 15 between closed ends. In the example shown here, the end face 15 which is provided with bores 19 is equipped with the recess 20. Accordingly, the recess 20 extends along all bores 19, so that each of the bores 19 opens into the recess 20. Essentially it may be sufficient if, when there are two adjacent stator heat shields 6 in the circumferential direction, only one of the end faces 15 opposite one another in the gaps 17 is equipped with bores 19 and only one of the end faces 15 is equipped with such a recess 20. Expediently, however, both end faces 15 may also be equipped with bores 19 and such a recess 20.

The recesses 20 allow the cooling gas to escape through the bores 19 to an adequate extent even when the gap 17 is comparatively narrow in the circumferential direction owing to relative movements of the neighboring stator heat shields 6. With the help of the bores 19, cooling of the sealing elements 18 can be accomplished during operation of the gas turbine 1. In particular, a cooling gas film can be produced on the hot gas side of the sealing elements 18, interfering with direct exposure to the hot gas on the sealing elements 18. At the same time, the end areas of the respective stator heat shield 6 on the circumference that are equipped with the end faces 15 can be effectively cooled in this way, namely first due to the flow of cooling gas through these end areas and secondly due to the development of the cooling gas film on the areas of the end face 15 and the outside 11 that are exposed to the hot gas path 9.

According to FIGS. 2 and 3, an indentation 21 is expediently formed on the inside 12. The ribs 13 are arranged in this indentation 21, namely in such a way that a system of intercommunicating channels 22 is formed within the indentation 21. The at least one baffle plate 14 covers this system of channels 22 with respect to the cooling gas path 10. Within these channels 22, there is convective heat transfer between the respective stator heat shield 6 and the respective baffle plate 14. At the same time, a cooling gas flow can pass through the channel system formed with the channels 22. For example, to this end the respective baffle plate 14 has a plurality of through-openings 23 through which the cooling gas can go from the cooling gas path 10 through the baffle plate 14 into the channels 22. The aforementioned bores 19 then open on the inside 12 in said indentation 21 and/or in one of the channels 22. Thus the cooling gas entering the channel system through the through-openings 23 can escape again through the bores 19 and can pass through the stator heat shield 6 to the hot gas side.

Several holders 24, with the help of which the respective baffle plate 14 can be secured on the stator heat shield 6, are provided on the inside 12. For example, the respective holders 24 extend beyond the respective baffle plate 14 for this reason.

The ribs 13 each have a certain rib height 25 with which they extend radially. The ribs 13 here stand away from the bottom of the indentation 21 with this rib height 25. In addition, the individual ribs 13 have a rib spacing 26 from one another in the circumferential direction. According to an advantageous embodiment, the rib height 25 and the rib spacing 26 must be coordinated with one another so as to yield a ratio of the rib height 25 to rib spacing 26 of less than 0.5 and preferably greater than 0.3; this ratio is expediently in a range from 0.328 to 0.492. The ratio of the rib height 25 to the rib spacing 26 is advantageously in the range of 0.41±20%.

The individual bores 19 also have a certain bore spacing 27 in relation to one another in the axial direction. Furthermore, each individual bore has a certain bore diameter 28. Here again, with a special embodiment it is possible to provide for the respective bore diameter 28 and the bore spacing 27 to be coordinated with one another so as to yield a ratio of bore diameter 28 to bore spacing 27 greater than 0.09 and expediently less than 0.15; this ratio is preferably in a range from 0.0992 to 0.1488. The ratio of the bore diameter 28 to the bore spacing 27 is advantageously in the range of 0.124±20%.

LIST OF REFERENCES

1 Gas turbine
2 Stator
3 Rotor
4 Guide vane
5 Guide vane carrier
6 Stator heat shield
7 Rotor blade
8 Axis of rotation
9 Hot gas path
10 Cooling gas path
11 Outside
12 Inside
13 Rib
14 Baffle plate
15 End face
16 Groove
17 Axial gap
18 Sealing element
19 Bore
20 Recess
21 Indentation
22 Channel
23 Through-opening
24 Holder
25 Rib height
26 Rib spacing
27 Bore spacing
28 Bore diameter While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A stator heat shield for a gas turbine, the gas turbine having a rotor defining an axis of rotation, the stator heat shield comprising:

an outside surface facing a hot gas path of the gas turbine when in an installed configuration, an inside surface facing away from the outside surface, and a circumferential end face;

a plurality of ribs on the inside surface, each rib extending axially when in the installed configuration with respect to the axis of rotation and being circumferentially spaced apart from one another;

at least one baffle plate positioned on the inside surface and in contact with the plurality of ribs;

at least one groove formed in the end face and into which at least one sealing element can be inserted;

a plurality of bores spaced from the at least one groove in the direction of the outside surface on the end face at one end of each bore and opening at the other end of each bore on the inside surface, the plurality of bore being axially spaced apart; and a recess on the end face spaced from the groove in the direction of the outside surface, said recess being open only toward the outside surface and extending in the axial direction over the plurality of bores with the bores opening into the recess.

2. The stator heat shield according to claim 1, further comprising:

an indentation formed on the inside surface, the plurality of ribs being arranged in the indentation and forming a system of intercommunicating channels covered by the at least one baffle plate.

3. The stator heat shield according to claim 2, wherein the plurality of bores open in the indentation in one of the channels.

4. The stator heat shield according to claim 1, wherein the at least one baffle plate comprises a plurality of through-openings.

5. The stator heat shield according to claim 1, further comprising:

at least one holder configured and arranged to secure the at least one baffle plate, the at least one holder being positioned on the inside surface.

6. The stator heat shield according to claim 1, wherein a ratio of the height of the plurality of ribs to the spacing between any two adjacent ribs of said plurality of ribs is in the range of 0.41±20%.

7. The stator heat shield according to claim 1, wherein a ratio of the diameter of each of said plurality of bores to the spacing between any two adjacent bores of said plurality of bores is in the range of 0.124±20%.

8. The stator heat shield according to claim 7, wherein a ratio of the height of the plurality of ribs to the spacing between any two adjacent ribs of said plurality of ribs is in the range of 0.41±20%.

9. A gas turbine comprising:

a rotor defining an axis of rotation;

a stator; and at least one stator heat shield according to claim 1.

10. A stator heat shield for a gas turbine, the gas turbine having a rotor defining an axis of rotation, the stator heat shield comprising:

an outside surface facing a hot gas path of the gas turbine when in an installed configuration, an inside surface facing away from the outside surface, and a circumferential end face;

a plurality of ribs on the inside surface, each rib extending axially when in the installed configuration with respect to the axis of rotation and being circumferentially spaced apart from one another;

at least one baffle plate positioned on the inside surface and in contact with the plurality of ribs;

at least one groove formed in the end face and into which at least one sealing element can be inserted;

a plurality of bores spaced from the at least one groove in the direction of the outside surface on the end face at one end of each bore and opening at the other end of each bore on the inside surface, the plurality of bore being axially spaced apart; and an indentation formed on the inside surface, the plurality of ribs being arranged in the indentation and forming a system of intercommunicating channels covered by the at least one baffle plate.

11. A gas turbine comprising:

a rotor defining an axis of rotation;

a stator; and at least one stator heat shield according to claim 10.

12. A stator heat shield for a gas turbine, the gas turbine having a rotor defining an axis of rotation, the stator heat shield comprising:

an outside surface facing a hot gas path of the gas turbine when in an installed configuration, an inside surface facing away from the outside surface, and a circumferential end face;

a plurality of ribs on the inside surface, each rib extending axially when in the installed configuration with respect to the axis of rotation and being circumferentially spaced apart from one another;

at least one baffle plate positioned on the inside surface and in contact with the plurality of ribs;

at least one groove formed in the end face and into which at least one sealing element can be inserted;

a plurality of bores spaced from the at least one groove in the direction of the outside surface on the end face at one end of each bore and opening at the other end of each bore on the inside surface, the plurality of bore being axially spaced apart; and at least one holder configured and arranged to secure the at least one baffle plate, the at least one holder being positioned on the inside surface.

13. A gas turbine comprising:

a rotor defining an axis of rotation;

a stator; and at least one stator heat shield according to claim 12.

* * * * *